US008048180B2

(12) United States Patent
Oh et al.

(10) Patent No.: US 8,048,180 B2
(45) Date of Patent: Nov. 1, 2011

(54) DUAL CYCLONE DUST-COLLECTING APPARATUS VACUUM CLEANER

(75) Inventors: Jang-Keun Oh, Gwangju (KR); Jung-Gyun Han, Gwangju (KR)

(73) Assignee: Samsung Electronics Co., Ltd., Gwangju-si (KR)

( * ) Notice: Subject to any disclaimer, the term of this patent is extended or adjusted under 35 U.S.C. 154(b) by 417 days.

(21) Appl. No.: 12/225,332

(22) PCT Filed: Aug. 17, 2006

(86) PCT No.: PCT/KR2006/003214

§ 371 (c)(1), (2), (4) Date: Sep. 18, 2008

(87) PCT Pub. No.: WO2007/126181

PCT Pub. Date: Nov. 8, 2007

(65) Prior Publication Data

US 2010/0224073 A1 Sep. 9, 2010

(30) Foreign Application Priority Data

May 3, 2006 (KR) ..... 10-2006-0040108

(51) Int. Cl.
*B01D 50/00* (2006.01)

(52) U.S. Cl. ..... 55/337; 55/345; 55/346; 55/429; 55/428; 96/416; 15/347; 15/352; 15/353

(58) Field of Classification Search ..... 55/337, 55/345, 346, 429, 428, DIG. 3; 15/347, 352, 15/353

See application file for complete search history.

(56) References Cited

U.S. PATENT DOCUMENTS 1,521,872 A 1/1925 Dellinger
1,954,924 A 4/1934 Engberg et al.
(Continued)

FOREIGN PATENT DOCUMENTS

DE 2413103 9/2005
(Continued)

OTHER PUBLICATIONS

Extended European Search Report for corresponding European Patent Application No. 07291551.5 dated Sep. 24, 2009.

(Continued)

*Primary Examiner* — Jason M Greene
*Assistant Examiner* — Dung H Bui
(74) *Attorney, Agent, or Firm* — Ohlandt, Greeley, Ruggiero & Perle, LLP

(57) ABSTRACT

A dual cyclone dust-collecting apparatus of a vacuum cleaner is disclosed. The dust-collecting apparatus includes an air inlet through which an external air is drawn in, two cyclone chambers into which the external air drawn in through the air inlet air is drawn in, the two cyclone chamber being disposed in parallel, at least one dust-collecting chamber divided in parallel with respect to the two cyclone chambers, and two air outlets through which the external air from the two cyclone chambers is discharged. The air inlet is formed between the two cyclone chambers at a lower part of a cyclone body and the two air outlets are formed in bottom surfaces of the two cyclone chambers, respectively, so that the external air is drawn in through lower parts of one sides of the two cyclone chambers and then discharged through the bottom surfaces of the two cyclone chambers.

14 Claims, 5 Drawing Sheets

U.S. PATENT DOCUMENTS

| | | | | |
|---|---|---|---|---|
| 3,371,985 | A | 3/1968 | Wyka | |
| 5,967,412 | A | 10/1999 | Lee | |
| 7,410,516 | B2 * | 8/2008 | Ivarsson et al. | 55/337 |
| 7,419,521 | B2 * | 9/2008 | Oh et al. | 55/337 |
| 7,559,964 | B2 * | 7/2009 | Oh et al. | 55/424 |
| 7,604,674 | B2 * | 10/2009 | Han et al. | 55/337 |
| 7,686,861 | B2 * | 3/2010 | Oh | 55/429 |
| 7,753,976 | B2 * | 7/2010 | Hyun et al. | 55/343 |
| 2005/0229554 | A1 * | 10/2005 | Oh et al. | 55/346 |
| 2006/0117721 | A1 * | 6/2006 | Lee et al. | 55/337 |
| 2006/0156699 | A1 * | 7/2006 | Kim | 55/345 |
| 2007/0011997 | A1 * | 1/2007 | Han et al. | 55/337 |
| 2007/0079583 | A1 * | 4/2007 | Oh | 55/345 |

FOREIGN PATENT DOCUMENTS

| | | |
|---|---|---|
| DE | 102004050911 | 11/2005 |
| EP | 0018197 | 10/1980 |
| EP | 1561477 | 8/2005 |
| GB | 2413103 | 5/2004 |
| GB | 2406067 | 11/2005 |
| GB | 2417674 | 8/2006 |
| GB | 2454293 | 5/2009 |
| JP | 2004135700 | 5/2004 |
| KR | 1020050080918 | 8/2005 |
| KR | 1020050100913 | 10/2005 |
| RU | 1546080 | 2/1990 |
| WO | 2004/093631 | 11/2004 |

OTHER PUBLICATIONS

Office Action for corresponding Russian Patent Application No. 2008147660 dated Jan. 28, 2010.

Notice of Allowance for corresponding Russian Patent Application No. 2008147660 dated May 14, 2010.

Extended European Search Report for corresponding European Patent Application No. 06783625.4 dated Jul. 21, 2009.

* cited by examiner

[Fig. 1]
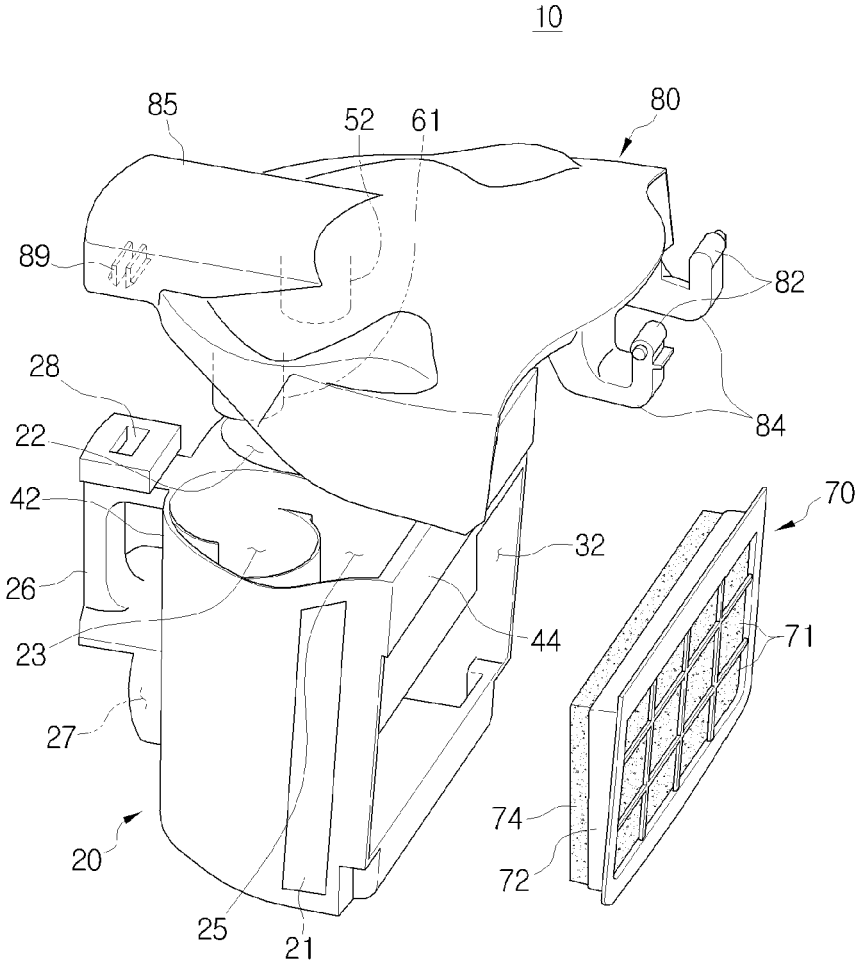
[Fig. 2]
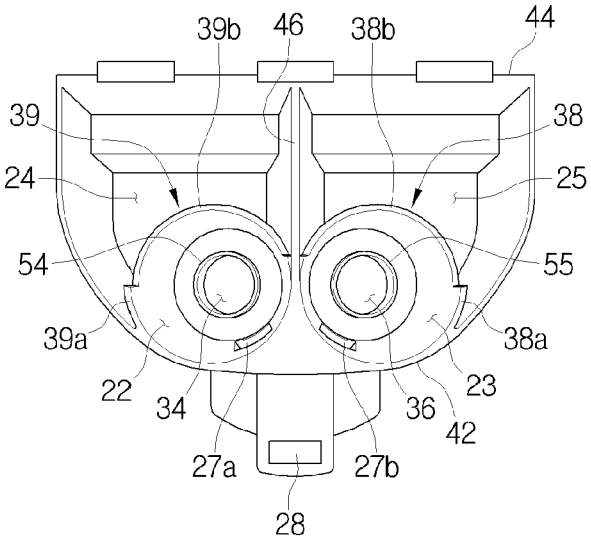

[Fig. 3]
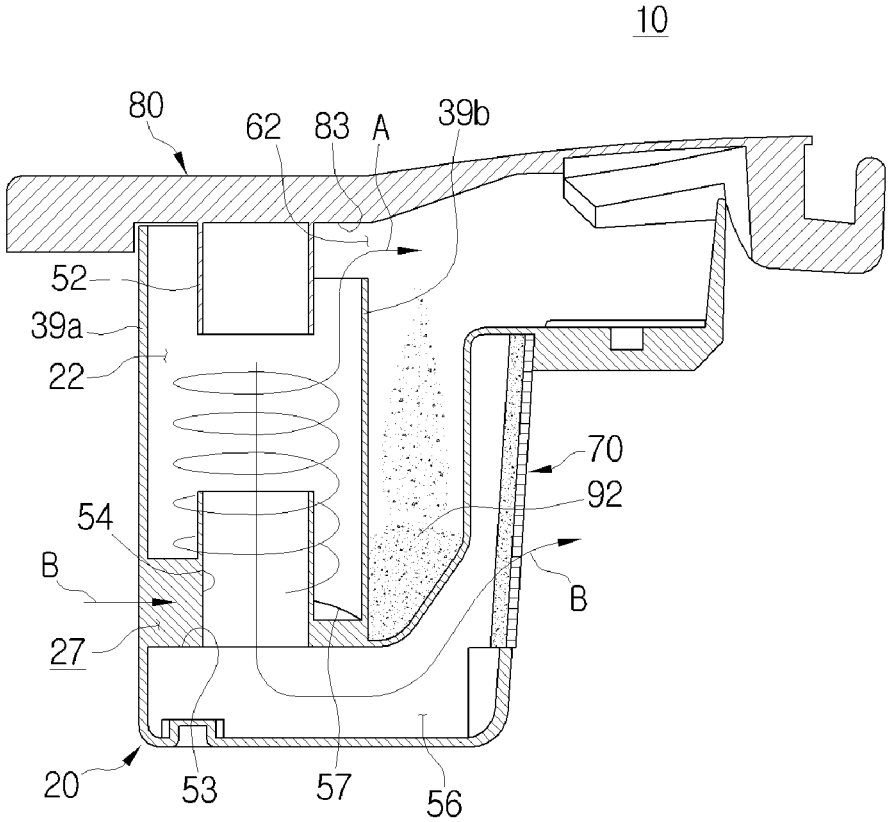
[Fig. 4]
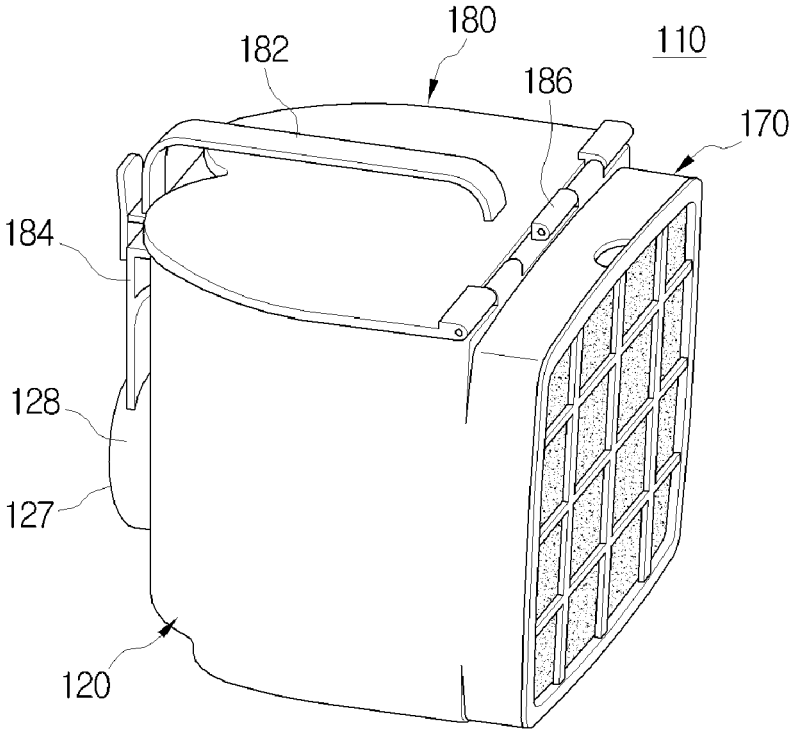

[Fig. 5]
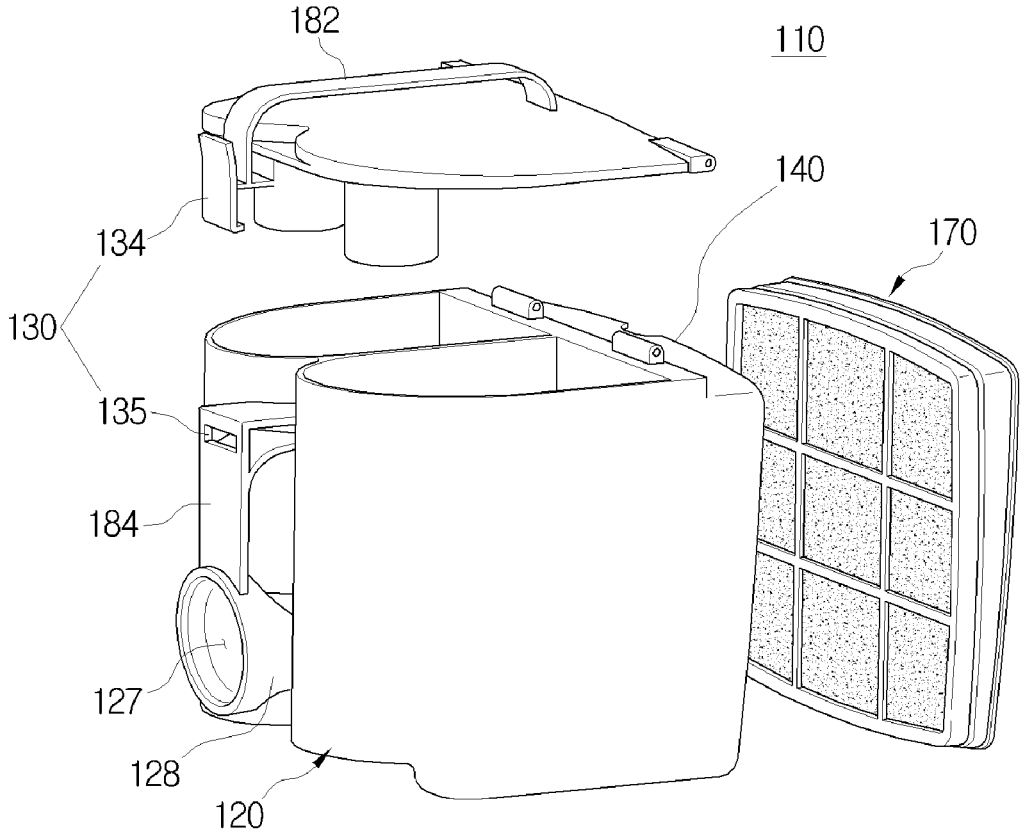
[Fig. 6]
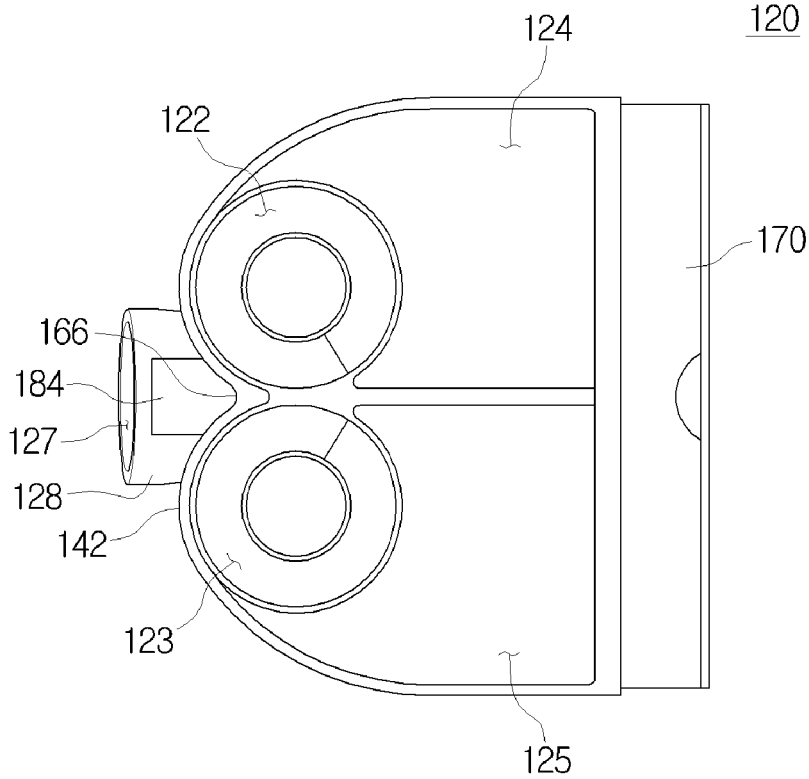

[Fig. 7]
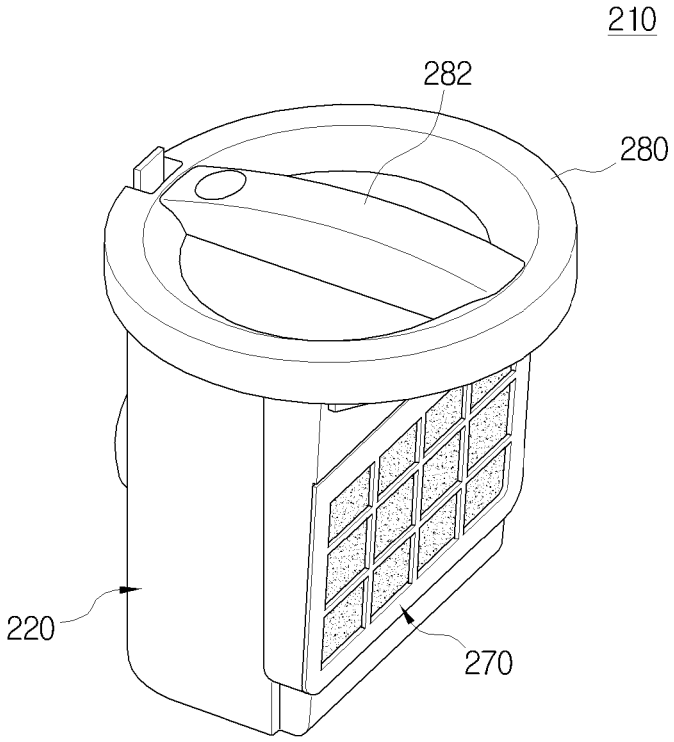
[Fig. 8]
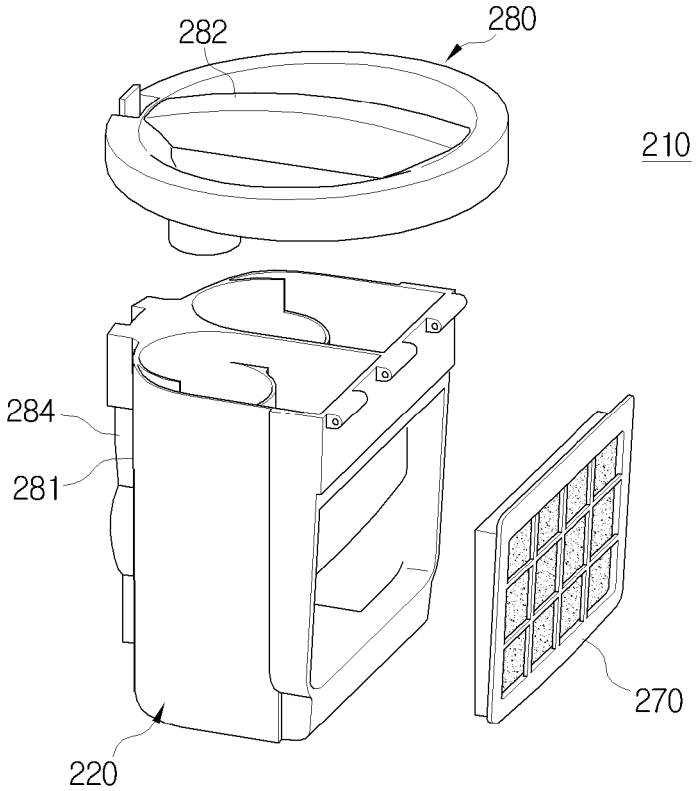

[Fig. 9]
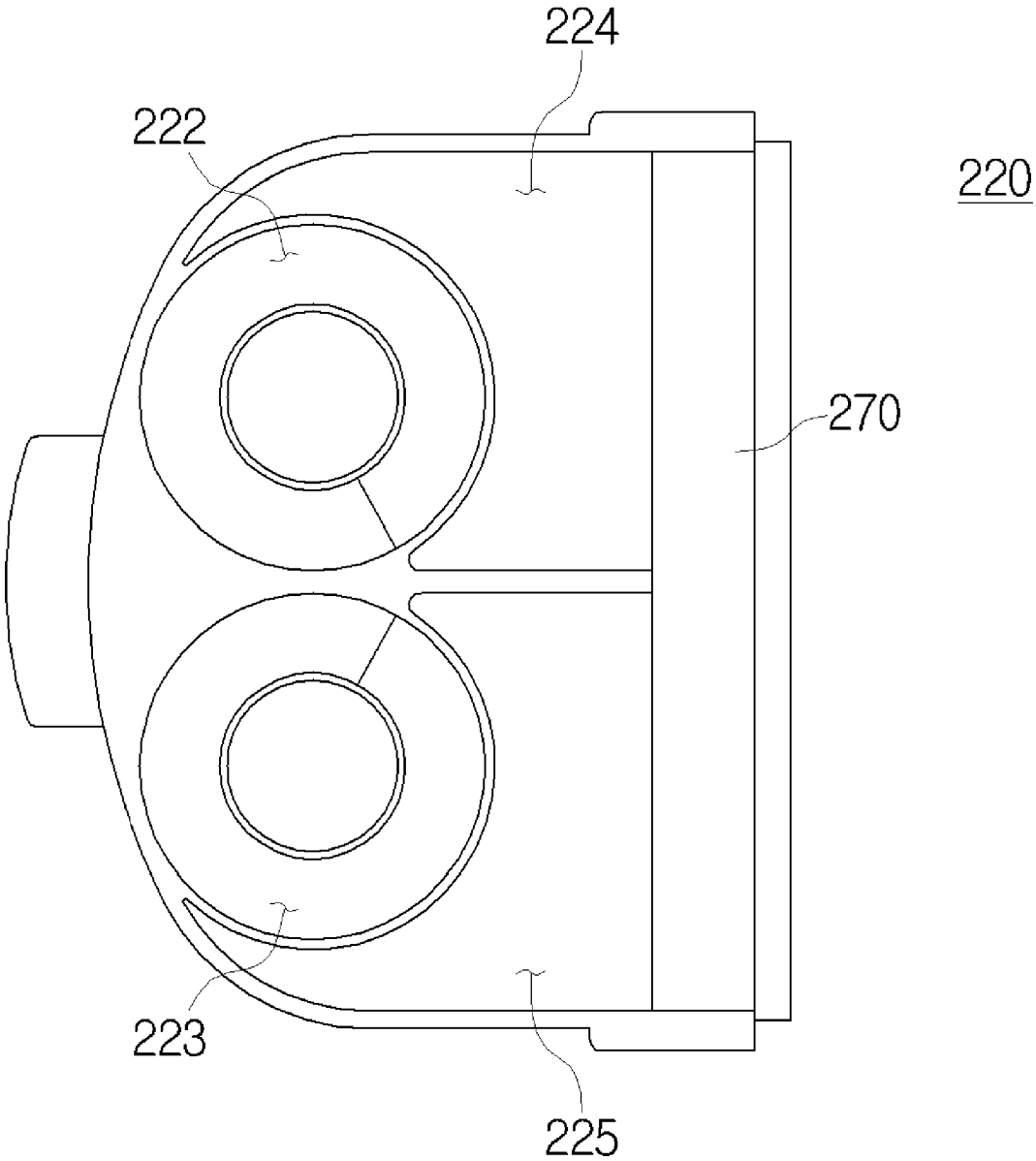

DUAL CYCLONE DUST-COLLECTING APPARATUS VACUUM CLEANER

TECHNICAL FIELD

The present invention relates to a dust-collecting apparatus, and more particularly, to a dual cyclone dust-collecting apparatus, which draws in an external air and then separates dust or dirt therefrom.

BACKGROUND ART

A cyclone dust-collecting apparatus, which whirls an external air and separates dirt from the external air using a centrifugal, has been used from long time ago. Particularly, a dual cyclone dust-collecting apparatus, which two sub-cyclone dust-collecting apparatus are installed in parallel to improve a dust separating or collecting efficiency, is also known already.

A large size dual cyclone dust-collecting apparatus is disclosed by Dyson et al. in EP patent publication No. 0018197. Two sub-cyclone dust-collecting apparatus of a large size are arranged in an upright type vacuum cleaner. However, such a large size dual cyclone dust-collecting apparatus is not used in the present time, since it is too large and inconvenient to use and has a complicated structure.

In recent, a dual cyclone dust-collecting apparatus, which is miniaturized to be applicable to a small size vacuum cleaner, has been disclosed in Japanese patent publication No. 2004-135700. However, the dual cyclone dust-collecting apparatus is configured, so that two sub-cyclone dust-collecting apparatus are horizontally arranged and a dust-collecting chamber is disposed below the two sub-cyclone dust-collecting apparatus. Accordingly, the dual cyclone dust-collecting apparatus enlarges in height and volume. In addition, the dual cyclone dust-collecting apparatus is configured, so that a flow of drawn-in air is abruptly bent at an angle of 90°, thereby increasing a loss in flowing passage and decreasing an inhalation force. Also, it is difficult to separate the dust-collecting chamber from the dual cyclone dust-collecting apparatus, and thus it is troublesome to dump dust from the dust-collecting chamber. Also, if the dual cyclone dust-collecting apparatus does not have a separate electrical measuring device installed therein, it is difficult to confirm an amount of dust from the outside.

DISCLOSURE OF INVENTION

Technical Problem

To address the problems as described above, applicant has proposed a dual cyclone dust-collecting apparatus in which cyclone parts and duct-collecting spaces are arranged in parallel, and registered it as Korean patent No. 549990 in the Korean Intellectual Property Office. However, the dual cyclone dust-collecting apparatus is configured, so that air is drawn in through an upper part, moved down, and then turned again at an angle of 180° to be discharged through the upper part, thereby increasing a loss in inhalation force, and a dust-collecting chamber is communicated with lower parts of cyclone chambers, thereby resulting in a problem that dirt collected into the dust-collecting chamber is returned into the cyclone chambers. Accordingly, what is needed is dual cyclone dust-collecting apparatus that is capable of obtaining an improved inhalation force and preventing dirt collected into the dust-collecting chamber from returning into the cyclone chambers.

Technical Solution

An aspect of the present invention is to solve at least the above problems and/or disadvantages and to provide at least the advantages described below. Accordingly, an aspect of the present invention is to provide a dual cyclone dust-collecting apparatus capable of preventing dirt collected into dust-collecting chambers from returning into cyclone chambers, and obtaining an improved inhalation force, while having a structure which is compacted and short in height.

Another aspect of the present invention is to provide a dual cyclone dust-collecting apparatus having an improved dust separating or collecting efficiency.

According to an aspect of an exemplary embodiment of the present invention, a dust-collecting apparatus includes an air inlet through which an external air is drawn in, two cyclone chambers into which the external air drawn in through the air inlet air is drawn in, the two cyclone chamber being disposed in parallel, at least one dust-collecting chamber formed to be divided in parallel with respect to the two cyclone chambers, and two air outlets through which the external air from the two cyclone chambers is discharged. The air inlet is formed between the two cyclone chambers at a lower part of a cyclone body and the two air outlets are formed in bottom surfaces of the two cyclone chambers, respectively, so that the external air is drawn in through lower parts of one sides of the two cyclone chambers and then discharged through the bottom surfaces of the two cyclone chambers.

The apparatus may further include a cover able to simultaneously open and close the two cyclone chambers, and/or a filter assembly to filter fine dust from the air discharged through the two air outlets.

The two cyclone chambers, the air inlet, and the two air outlets may he formed as a body by an injection molding.

According to another aspect of an exemplary embodiment of the present invention, a dust-collecting apparatus includes a cyclone body having an air inlet, a plurality of cyclone chambers, a plurality of dust-collecting chambers, and a plurality of air outlets, formed therein, and a cover to open and close a top of the cyclone body. The air inlet is formed at a lower part of one side of the cyclone body and the plurality of air outlets are formed by the same number as that of the plurality of cyclone chambers in bottom surfaces of the plurality of cyclone chambers.

An air passage may be formed in a lower part of the cyclone body so as to join airs discharged from the plurality of air outlets together, and a filter assembly may be disposed at a side of the cyclone body so as to filter dust from the airs discharged from the plurality of air outlets.

A rotating center axle of the cover may be disposed in the cyclone body, or in a body of a vacuum cleaner.

At least a portion of the cyclone body may he transparently formed, so that the plurality of dust-collecting chambers are exposed to the outside therethrough. Also, center pipes may be disposed by the same number as that of the plurality of cyclone chambers in an undersurface of the cover.

Advantageous Effects

As described above, according to an aspect of the present invention, the dual cyclone dust-collecting apparatus is configured, so that the two cyclone chambers and the two dust-collecting chambers are disposed in parallel. Accordingly, the dual cyclone dust-collecting apparatus according to the exemplary embodiments of the present invention has a structure, which is compacted and short in height.

Further, the dual cyclone dust-collecting apparatus is configured, so that the two cyclone chambers are disposed in parallel, thereby increasing a sectional area of flowing passage, and the air is drawn in to the lower parts of the cyclone chambers and then discharged in the same direction as the gravity, thereby increasing the inhalation force. Accordingly, the dust separating or collecting efficiency is improved.

Also, the dual cyclone dust-collecting apparatus includes the single cyclone body in which the two cyclone chambers and the two dust-collecting chambers are integrally formed by the injection molding. Accordingly, the dual cyclone dust-collecting apparatus according to the exemplary embodiments of the present invention comes to be compacted, and the number of the assembling processes is reduced, thereby increasing the productivity.

Also, the dual cyclone dust-collecting apparatus includes the cyclone body having the portion formed of the transparent material, thereby easily confirming the amount of dust collected in the dust-collecting chambers from the outside.

DESCRIPTION OF DRAWINGS

The above aspect and other features of the present invention will become more apparent by describing in detail exemplary embodiments thereof with reference to the attached drawing figures, wherein;

FIG. 1 is an exploded perspective view exemplifying a dual cyclone dust-collecting apparatus according to a first exemplary embodiment of the present invention;

FIG. 2 is a perspective view exemplifying a cyclone body of the dual cyclone dust-collecting apparatus of FIG. 1, which is looked down from the above;

FIG. 3 is a cross sectional view of the dual cyclone dust-collecting apparatus of FIG. 1;

FIG. 4 is a perspective view exemplifying a dual cyclone dust-collecting apparatus according to a second exemplary embodiment of the present invention;

FIG. 5 is an exploded perspective view of the dual cyclone dust-collecting apparatus of FIG. 4;

FIG. 6 is a top plan view exemplifying a cyclone body of the dual cyclone dust-collecting apparatus of FIG. 4;

FIG. 7 is a perspective view exemplifying a dual cyclone dust-collecting apparatus according to a third exemplary embodiment of the present invention;

FIG. 8 is an exploded perspective view of the dual cyclone dust-collecting apparatus of FIG. 7; and FIG. 9 is a top plan view exemplifying a cyclone body of the dual cyclone dust-collecting apparatus of FIG. 7.

Throughout the drawings, the same drawing reference numerals will be understood to refer to the same elements, features, and structures.

BEST MODE

The matters defined in the description such as a detailed construction and elements are provided to assist in a comprehensive understanding of the embodiment of the invention and are merely exemplary. Accordingly, those of ordinary skill in the art will recognize that various changes and modifications of the embodiment described herein can be made without departing from the scope and spirit of the invention. Also, descriptions of well-known functions and constructions are omitted for clarity and conciseness.

FIGS. 1 through 3 are views exemplifying a dual cyclone dust-collecting apparatus 10 according to a first exemplary embodiment of the present invention. FIG. 1 is an exploded view of the dust-collecting apparatus in which respective components are illustrated as exploded, FIG. 2 is a perspective view of the dust-collecting apparatus, which is looked down from the above while omitting a cover, and FIG. 3 is a cross sectional view of the dust-collecting apparatus.

Referring to FIGS. 1 through 3, the dual cyclone dust-collecting apparatus 10 according to the first exemplary embodiment of the present invention includes a cyclone body 20, a cover 80, and a filter assembly 70.

To facilitate an assembling process of the dust-collecting apparatus, the cyclone body 20 is formed as a body by an injection molding. The cyclone body 20 has a front 42 in the shape of circular arc and a rear 44 in the shape of straight line, so that taken as a whole, it is formed in a D-lettered shape, when looked down from the above (see FIG. 2). The cyclone body 20 is provided with an air inlet 27, first and second cyclone chambers 22 and 23, first and second dust-collecting chambers 24 and 25, an air passage 56 (see FIG. 3), and a filter mounting space 32 (see FIG. 2). A handle 26 is formed on the front 42 of the cyclone body 20, so that user can separate the cyclone body 20 in a horizontal direction from a vacuum cleaner (not illustrated) after lifting the cover 80 up. Referring to FIG. 1, on a top of the handle 26 is formed a locking groove 28 into which a locking member 89 can be locked. The locking member 89 is formed on an undersurface of a protruding part 85 of the cover 80. A portion 21 of the cyclone body 20 is formed of a transparent material, so that user can easily confirm an amount of dust collected in the dust-collecting chambers 24 and 25 from the outside. Alternatively, among the cyclone body 20, all the walls forming the dust-collecting chambers 24 and 25 can be formed of a transparent material.

The air inlet 27 is formed between the first and the second cyclone chamber 22 and 23 at a lower part of the front 42 of the cyclone body 20. To be more specific, the air inlet 27 is disposed at a center of the lower part of the front 42, so that an external air is separated into two same volumes and drawn into the first and the second cyclone chambers 22 and 23. The air inlet 27 is divided into two sub-inlets 27*a* and 27*b* by a separating partition 46, so that the external air drawn into each of lower parts of the first and the second cyclone chambers 22 and 23 moves up while whirling.

The first and the second cyclone chambers 22 and 23 are divided and separated from each other by the separating partition 46, and are disposed in parallel in close contact with each other. Referring to FIG. 3, discharging pipes 54 and 55 are protruded up from bottom surfaces 53 in the first and the second cyclone chambers 22 and 23. Spiral whirling guide members 57 are formed around outer circumferential surfaces of the discharging pipes 54 and 55, so that the external air drawn in through the air inlet 27 can be guided to move up while whirling. Referring to FIG. 2, the first and the second cyclone chambers 22 and 23 are divided from the first and the second dust-collecting chambers 24 and 25 by cylindrical walls 38 and 39, and the first and the second dust-collecting chambers 24 and 25 are divided from each other by the separating partition 46. The cylindrical walls 38 and 39 defining the first and the second dust-collecting chambers 24 and 25 are configured, so that bordering walls 38*b* and 39*b*, which border on the first and the second dust-collecting chambers 24 and 25, have a height lower than that of front walls 38*a* and 39*a*. That is, as illustrated in FIG. 3, the bordering walls 38*b* and 39*b* and the front walls 38*a* and 39*a* are configured, so that when the cover 80 is closed, the front walls 38*a* and 39*a* come in contact with the cover 80 and tops of the bordering walls 38*b* and 39*b* are spaced apart from an undersurface 83 of the cover 80, thereby forming a dust-moving passage 62 between the cyclone chambers 22 and 23 and the dust-collecting chambers 24 and 25.

Referring to FIGS. 2 and 3, the first and the second dust-collecting chambers 24 and 25 are formed in parallel with respect to the first and the second cyclone chambers 22 and 23 at the rear of the first and the second cyclone chambers 22 and 23, and are communicated with the first and the second cyclone chambers 22 and 23 through the dust-moving passage 62. Also, the first and the second dust-collecting chambers 24 and 25 are separated from each other by the separating partition 46 so as to prevent dust or dirt collected therein from being mixed.

Referring to FIG. 3, the air passage 56 is communicated with air outlets 34 and 36 of the first and the second cyclone chambers 22 and 23 to guide the air to the filter assembly 70, which is disposed at the rear of the cyclone body 20. The air passage 56 is formed all over the lower part of the cyclone body 20, i.e., below the lower parts of the first and the second cyclone chambers 22 and 23, so that the airs discharged from the air outlets 34 and 36 of the first and the second cyclone chambers 22 and 23 are joined thereat and then moved toward the filter assembly 70.

Referring to FIG. 1, the filter assembly 70 is mounted in the filter mounting space 32 at the rear of the cyclone body 20, and includes a porous filter 74 and a filter frame 72. The filter assembly 70 filters again the airs from which dust is first separated in the first and the second cyclone chamber 22 and 23, so as to remove fine dust therefrom. The porous filter 74 and the filter frame 72 can be formed of a member such as a sponge or a non-woven fabric, and a plastic material in which a plurality of opening 71 are formed, respectively. Referring to FIG. 3, the filter assembly 70 is configured to have a height spaced apart from the undersurface 83 of the cover 80, thereby more increasing inner spaces of the first and the second dust-collecting chambers 24 and 25.

Referring to FIGS. 1 and 3, the cover 80 forms the exterior of the vacuum cleaner. Two arms 84 are protruded in an U-lettered shape from a side of the cover 80. The two arms 84 at tips thereof have hinge axles 82, which are pivotally coupled to the vacuum cleaner. Accordingly, when user wants to dump the dust collected in the first and the second dust-collecting chambers 24 and 25, he/she can dump the dust by lifting the cover 80 up and then moving and separating the cyclone body 20 in the horizontal direction. On the undersurface 83 of the cover 80 are formed two centering pipes 52 and 61. Referring to FIG. 3, when the cover 80 is closed, one centering pipe 52 is positioned at an upper center of the first cyclone chamber 22, and the other centering pipe 61 is positioned at an upper center of the second cyclone chamber 23, thereby centering air currents, which whirl in the first and the second cyclone chambers 22 and 23.

Hereinafter, an operation of the dual cyclone dust-collecting apparatus 10 according to the first exemplary embodiment of the present invention will now he described with reference to FIGS. 1 through 3.

An external air is drawn in through the air inlet 27, and then divided into two sections to be drawn into the lower parts of the first and the second cyclone chambers 22 and 23. The airs drawn into the cyclone chambers 22 and 23 rotate around the discharging pipes 54 and 55 along the whirling guide members 57, and move up whirling in an opposite direction to the gravity. While the airs move up whirling, dirt or dust 92 heavier than the airs falls down into the first and the second dust-collecting chambers 24 and 25 through the dust-moving passage 62, which is a space between the undersurface 83 of the cover 80 and the bordering walls 38*b* and 39*b* of the first and the second cyclone chambers 22 and 23. And, the airs are discharged in the same direction as the gravity through the discharging pipes 54 and 55 and the air outlets 34 and 36 formed in the bottom surfaces 53 of the first and the second cyclone chambers 22 and 23. In FIG. 3, a flow of the air is marked by an arrow B, and a flow of the dirt or dust 92 is marked by an arrow A.

The airs discharged from the first and the second cyclone chambers 22 and 23 are joined at the air passage 56 formed below the first and the second cyclone chambers 22 and 23, and then moved toward a vacuum motor (not illustrated) via the filter assembly 70 disposed at the rear of the cyclone body 20. While the airs pass through the porous filter 74 of the filter assembly 70, the porous filter 74 filters fine dust laden in the airs, so that only purified airs pass through the filter assembly 70.

FIGS. 4 through 6 are views exemplifying a dual cyclone dust-collecting apparatus 110 according to a second exemplary embodiment of the present invention. FIG. 4 illustrates a perspective view of the dust-collecting apparatus 110 in which respective components are assembled, FIG. 5 is an exploded perspective view of the dust-collecting apparatus in which respective components are exploded, and FIG. 6 is a top plan view of a cyclone body 120 of the dust-collecting apparatus, which is looked down from the above.

Since the basic structure of the dust-collecting apparatus 110 are the same as that of the dust-collecting apparatus 10 of the first exemplary embodiment, detailed descriptions and illustrations thereof except for components different from the dust-collecting apparatus 10 of the first exemplary embodiment will he omitted for clarity and conciseness.

A rotating center axle 186 of a cover 180 is formed at a top of a cyclone body 120. Above the upper surface of the cover 180 is disposed a first handle 182, which is griped by user. Accordingly, user can take the dust-collecting apparatus 110 out from and mount to a vacuum cleaner (not illustrated) in a vertical direction by using the first handle 182.

A filter assembly 170 is configured, so that it is wider than the filter assembly 70 of the first exemplary embodiment and has almost the same area as an entire area of a rear wall 140 of the cyclone body 120. Accordingly, the filter assembly 170 provides an improved fine duct-separating or collecting efficiency, and also comes to have a height, which is almost equal to an entire height of the of the cyclone body 120. In addition, as illustrated in FIG. 6, a concave part 166 is formed in a front 142 of the cyclone body 120. A second handle 184 and an air inlet pipe 128 forming an air inlet 127 are connected to the concave part 166. Accordingly, user can mount or separate the dust-collection apparatus 110 in a horizontal direction by using the second handle 184. The first handle 182 has a hook 134 protruded downward from a side thereof and the second handle 184 has a locking groove 135 into which an end tip of the hook 134 is inserted, so that when the cover 180 is closed, a side of the cover 180 is locked to the second handle 184 of the cyclone body 120. In FIG. 6, reference numerals 122 and 123 designate first and second cyclone chambers, and reference numerals 124 and 125 designate first and second dust-collecting chambers.

FIGS. 7 through 9 are views exemplifying a dual cyclone dust-collecting apparatus 210 according to a third exemplary embodiment of the present invention. FIG. 7 illustrates a perspective view of the dust-collecting apparatus 210 in which respective components are assembled, FIG. 8 is an exploded perspective view of the dust-collecting apparatus in which respective components are exploded, and FIG. 9 is a top plan view of a cyclone body 220 of the dust-collecting apparatus from which a cover is removed. Referring to FIGS. 7 through 9, the dual cyclone dust-collecting apparatus 210 of the third exemplary embodiment except includes a cover 280 having a structure different from that of the dual cyclone dust-collecting apparatus 10 or 110 of the first or second third exemplary embodiment. The cover 280 is formed in a circular shape. A fist handle 282 is formed on the cover 280, and a second handle 284 is formed on a front 281 of the cyclone body 220. Since the structure of components of the dual cyclone dust-collecting apparatus 210 except for the cover 280 is the same as that of the dual cyclone dust-collecting apparatus 10 or 110 of the first or second third exemplary embodiment, detailed descriptions and illustrations thereof will be omitted for clarity and conciseness. In the drawings, a reference numeral 270 designates a filter assembly 270, reference numerals 222 and 223 designate first and second cyclone chambers, and reference numerals 224 and 225 designate first and second dust-collecting chambers.

Although a few embodiments of the present invention have been shown and described, it would be appreciated by those skilled in the art that changes may he made in this embodiment without departing from the principles and spirit of the invention, the scope of which is defined in the claims and their equivalents.

Mode for Invention

INDUSTRIAL APPLICABILITY

The present invention is applicable to a dust-collecting apparatus, more particularly, a dual cyclone dust-collecting apparatus, which draws in an external air and then separates dust or dirt therefrom.

Sequence List Text

The invention claimed is:

1. A dust-collecting apparatus, comprising:

a cyclone body which comprises:

an air inlet through which an external air is drawn in;

at least one cyclone chamber which whirls the external air, and separates dirt or dust;

at least one dust-collecting chamber which is formed to be divided in parallel with respect to the cyclone chamber, and collects dirt or dust separated from the external air;

at least one air outlet through which the external air is discharged from the cyclone chamber, wherein the air inlet is formed at a lower part of the cyclone body, and the at least one air outlet is formed on a bottom surface of the cyclone chamber; and a filter assembly which is disposed at a rear wall of the cyclone body and removes fine dust from dust-laden air discharged through the cyclone chamber.

2. The apparatus as claimed in claim 1, wherein the cyclone chamber comprises therein:

a discharging pipe which is projected from the bottom surface of the cyclone chamber, and is connected to the air outlet; and a centering pipe which is projected from an upper surface of the cyclone chamber, and maintains whirling force of air ascending in the cyclone chamber.

3. The apparatus as claimed in claim 2, wherein the cyclone chamber and the dust-collecting chamber corresponding to the cyclone chamber are divided by a vertically disposed cylindrical wall.

4. The apparatus as claimed in claim 3, wherein a dust-mounting passage is formed on an upper part of the cylindrical wall so that dirt or dust separated from the cyclone chamber flow to the dust-collecting chamber.

5. The apparatus as claimed in claim 1, wherein the filter assembly which is mounted in a filter mounting space of the cyclone body, and removes the fine dust from dust-laden air discharged through the cyclone chamber.

6. The apparatus as claimed in claim 5, wherein the filter assembly comprises:

a filter frame which is detachably attached in the filter mounting space, and comprises a plurality of openings; and a filter member which is mounted in the filter frame, and filters fine dust from the dust-laden air discharged through the cyclone chamber.

7. The apparatus as claimed in claim 5, wherein an air passage is formed in the cyclone body so as to guide the air discharged through the bottom surface of the cyclone chamber to the filter assembly at the rear wall of the cyclone body.

8. The apparatus as claimed in claim 1, wherein two cyclone chambers and two dust-collecting chambers are provided.

9. The apparatus as claimed in claim 8, wherein the two cyclone chambers are disposed in parallel with each other, and the dust-collecting chambers corresponding to the cyclone chambers are disposed in parallel with each other.

10. The apparatus as claimed in claim 9, wherein the two cyclone chambers and the two dust-collecting chambers are divided by a single partition.

11. The apparatus as claimed in claim 10, wherein the air inlet is divided into two sub-inlets by the partition so that the two sub-inlets are connected to the two cyclone chambers.

12. A dust-collecting apparatus, comprising:

a cyclone body which comprises:

an air inlet through which an external air is drawn in;

at least one cyclone chamber which whirls the external air, and separates dirt or dust;

at least one dust-collecting chamber which is formed to be divided in parallel with respect to the cyclone chamber, and collects dirt or dust separated from the external air;

at least one air outlet through which the external air is discharged from the cyclone chamber, wherein the air inlet is formed at a lower part of the cyclone body, and the at least one air outlet is formed on a bottom surface of the cyclone chamber; and a cover which is connected to the cyclone body to be hingedly driven so as to open and close an upper part of the cyclone body.

13. The apparatus as claimed in claim 12, wherein the cover comprises:

a hinge axis which is formed on one end of the cover, and is connected to one side of the cyclone body; and a locking member which is formed on an opposite end of the cover, and is detachably attached to an opposite side of the cyclone body, wherein the cyclone body comprises:

a locking groove which is formed on the opposite side of the cyclone body, and into which the locking member is detachably inserted.

14. A dust-collecting apparatus, comprising:

a cyclone body which comprises:

an air inlet through which an external air is drawn in;

at least one cyclone chamber which whirls the external air, and separates dirt or dust;

at least one dust-collecting chamber which is formed to be divided in parallel with respect to the cyclone chamber, and collects dirt or dust separated from the external air; and at least one air outlet through which the external air is discharged from the cyclone chamber, wherein the air inlet is formed at a lower part of the cyclone body, and the at least one air outlet is formed on a bottom surface of the cyclone chamber, and wherein at least part of the cyclone body is transparently formed.

* * * * *